US011272789B2

(12) United States Patent
Tanaka

(10) Patent No.: US 11,272,789 B2
(45) Date of Patent: Mar. 15, 2022

(54) SEAT

(71) Applicant: Panasonic Intellectual Property Management Co., Ltd., Osaka (JP)

(72) Inventor: Shinji Tanaka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/005,253

(22) Filed: Aug. 27, 2020

(65) Prior Publication Data

US 2020/0390245 A1 Dec. 17, 2020

Related U.S. Application Data

(63) Continuation of application No. PCT/JP2019/021655, filed on May 31, 2019.

(30) Foreign Application Priority Data

Jul. 5, 2018 (JP) ..... JP2018-128423

(51) Int. Cl.
*A47C 7/74* (2006.01)
*A47C 7/40* (2006.01)

(52) U.S. Cl.
CPC ..... *A47C 7/744* (2013.01); *A47C 7/40* (2013.01)

(58) Field of Classification Search
CPC ..... A47C 7/40; A47C 7/744
USPC ..... 297/180.13, 180.14
See application file for complete search history.

(56) References Cited

U.S. PATENT DOCUMENTS

| | | | | |
|---|---|---|---|---|
| 2,782,834 | A * | 2/1957 | Benny | A47C 7/744 297/180.14 |
| 5,266,070 | A | 11/1993 | Hagiwara et al. | |
| 8,123,290 | B1 * | 2/2012 | Aiken | A47C 7/744 297/180.1 |
| 9,101,222 | B2 * | 8/2015 | Minkoff | A47C 7/66 |
| 10,029,797 | B2 * | 7/2018 | Space | B60N 2/5657 |
| 10,479,242 | B2 * | 11/2019 | Kato | B60N 2/5635 |
| 10,543,761 | B2 * | 1/2020 | Seiting | B60N 2/5671 |

(Continued)

FOREIGN PATENT DOCUMENTS

| | | | | |
|---|---|---|---|---|
| JP | 2-085930 U | | 7/1990 | |
| JP | 03159608 A | * | 7/1991 | A47C 7/744 |

(Continued)

OTHER PUBLICATIONS

International Search Report of PCT application No. PCT/JP2019/021655 dated Aug. 13, 2019.

*Primary Examiner* — Rodney B White
(74) *Attorney, Agent, or Firm* — Wenderoth, Lind & Ponack, L.L.P.

(57) ABSTRACT

A seat includes a backrest, and a fan that is installed on the backrest at a position corresponding to a height of a head of a sitter sitting on the seat and generates an airflow flowing from a front toward a rear of the backrest. The seat may further include a sitter detector that detects the height of the head of the sitter, a lifting-and-lowering motor that adjusts a height of the fan, and a lifting-and-lowering controller that controls the lifting-and-lowering motor. The lifting-and-lowering controller may control the lifting-and-lowering motor to adjust the height of the fan to the height of the head of the sitter detected by the sitter detector.

10 Claims, 8 Drawing Sheets

(56) References Cited

U.S. PATENT DOCUMENTS

| | | | | |
|---|---|---|---|---|
| 10,743,671 | B2 * | 8/2020 | Akaike | B60N 2/70 |
| 10,779,656 | B2 * | 9/2020 | Cothren | A47C 7/748 |
| 11,021,085 | B2 * | 6/2021 | Fujii | B60N 2/5657 |
| 11,077,780 | B2 * | 8/2021 | Akaike | B60N 2/20 |
| 2002/0041116 | A1 * | 4/2002 | Bogisch | B60N 2/5635 297/180.1 |
| 2003/0111877 | A1 * | 6/2003 | Collins | A47C 7/74 297/180.14 |
| 2005/0282486 | A1 * | 12/2005 | Takeda | B60N 2/56 454/158 |
| 2009/0134677 | A1 * | 5/2009 | Maly | B60N 2/5657 297/180.14 |
| 2013/0165033 | A1 * | 6/2013 | Fitzpatrick | B60N 2/5692 454/120 |
| 2014/0265462 | A1 * | 9/2014 | Fleming | A47C 7/666 297/180.14 |
| 2016/0009206 | A1 * | 1/2016 | Perraut | B60N 2/5635 297/180.12 |
| 2017/0318975 | A1 * | 11/2017 | Schwab | A47C 7/725 |
| 2018/0271286 | A1 * | 9/2018 | Jacobs | A63J 99/00 |
| 2018/0361891 | A1 * | 12/2018 | Kato | B60H 1/00285 |
| 2019/0142172 | A1 * | 5/2019 | Toda | B60N 2/5607 297/180.13 |
| 2019/0359106 | A1 * | 11/2019 | Suzuki | B60N 2/885 |
| 2020/0039398 | A1 * | 2/2020 | Rappl | B60N 2/5642 |

FOREIGN PATENT DOCUMENTS

| | | |
|---|---|---|
| JP | 5-261156 | 10/1993 |
| JP | 2000-175772 | 6/2000 |
| JP | 2005-348783 | 12/2005 |
| JP | 2011-147544 | 8/2011 |
| JP | 2015-037475 | 2/2015 |
| JP | 2016-002861 | 1/2016 |
| JP | 2016-020114 | 2/2016 |

* cited by examiner

SEAT

BACKGROUND

1. Technical Field

The present disclosure relates to a seat that reduces the risk of transmission of an airborne disease, such as a virus.

2. Description of the Related Art

Recently, there have been an increasing number of medical clinics that provide high levels of hospitality. For example, such a clinic has a pharmacist who is always on duty at the front desk. The pharmacist visits individual patients waiting in a waiting room of the clinic to dispense medicines with a detailed explanation of prescription following the doctor's diagnosis.

When handing medicines to a patient in the waiting room of the clinic, the pharmacist has to approach the patient's face to explain the medicines. If, for example, the patient is infected with an airborne disease, the pharmacist is highly likely to be exposed to air that contains a high concentration of virus around the patient. This increases the pharmacist's risk of getting infected with the patient's disease (i.e., the risk of transmission to the pharmacist).

There have been techniques that circulate air around a seat in such a manner that the seat is surrounded by airflow. This creates, around the seat, a personal space within which movement of air around the seat is limited. With such techniques, it is possible to isolate air around a person sitting on the seat (i.e., sitter) from air around a person not sitting (see, e.g., Japanese Unexamined Utility Model Registration Application Publication No. 2-85930).

In a seat disclosed in Japanese Unexamined Utility Model Registration Application Publication No. 2-85930, air taken in through an air inlet is moved through a duct and further moved downward from an air outlet panel at the top, so that the air is circulated around a person sitting on the seat.

Japanese Unexamined Patent Application Publication Nos. 2000-175772 and 2005-348783 each disclose a configuration that generates an airflow around a seat.

SUMMARY

With the seat configured as described above, however, a person who purposefully enters the personal space, such as a pharmacist who approaches a patient sitting on the seat, is still at risk of getting infected.

One non-limiting and exemplary embodiment provides a seat that can reduce the risk of transmission of an airborne disease to a nearby person who approaches a sitter infected with the disease.

In one general aspect, the techniques disclosed here feature a seat that includes a backrest and a fan installed on the backrest at a position corresponding to a height of a head of a sitter sitting on the seat. The fan generates an airflow flowing from a front toward a rear of the backrest.

The seat according to the present disclosure can reduce the risk of transmission of an airborne disease to a nearby person who approaches a sitter infected with the disease.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
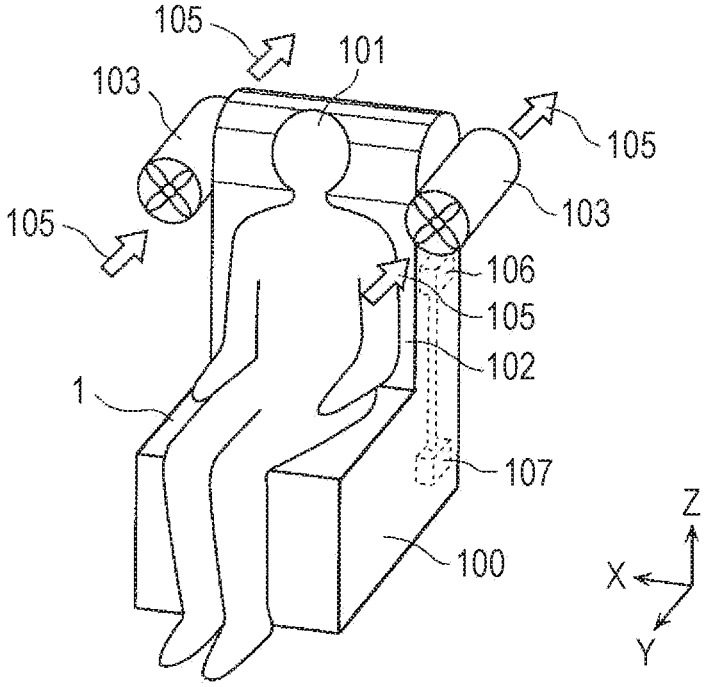
FIG. 1 is a schematic perspective view of a seat according to a first embodiment of the present disclosure.

Various aspects of the present disclosure will now be described.

A seat according to an aspect of the present disclosure includes a backrest, and a fan that is installed on the backrest at a position corresponding to a height of a head of a sitter sitting on the seat and generates an airflow flowing from a front toward a rear of the backrest.

With this configuration, for example, when a pharmacist approaches a patient infected with a disease to explain medicines to the patient (or an exemplary sitter sitting on the seat, such as a sofa, according to the aspect of the present disclosure), air around the head (or specifically, face) of the sitter (or patient) can be removed toward the rear of the backrest. A large quantity of virus that causes an airborne disease is contained particularly in patient's exhaled breath or air around the face of the patient. Therefore, when air around the head of the sitter, that is, air containing a high concentration of virus, is removed toward the rear of the seat, the risk of airborne transmission to a nearby person, such as a pharmacist, who approaches a patient from the front of the patient can be reduced. Thus, the seat according to the aspect of the present disclosure can reduce the risk of transmission to the nearby person who approaches the sitter infected with an airborne disease.

Also, for example, the seat according to the aspect of the present disclosure may include more than one fan. The fans may be installed at the same height and spaced apart in a right-and-left direction of the backrest.

With this configuration, for example, even when the seat according to the aspect of the present disclosure is a long seat, such as a sofa, which accommodates more than one person, the risk of transmission to a person approaching the sitter can be reduced by placing the fans on the backrest, with an appropriate distance therebetween. Also, when the fans are placed on the backrest, with a certain distance therebetween, the airflow generated by the fans can be prevented from being blocked by the sitter sitting on the seat. It is thus possible to reduce sitters discomfort caused by the airflow hitting the sitter, and to remove air around the face of the sitter toward the rear of the backrest.

The seat according to the aspect of the present disclosure may further include, for example, a sitter detector that detects the height of the head of the sitter, a lifting-and-lowering motor that adjusts a height of the fan, and a lifting-and-lowering controller that controls the lifting-and-lowering motor. The lifting-and-lowering controller may control the lifting-and-lowering motor to adjust the height of the fan to the height of the head of the sitter detected by the sitter detector.

This configuration enables the fan to be positioned at a height appropriate for the sitter's sitting height, which varies from one person to another. With this configuration, therefore, air around the face of the sitter can be appropriately removed toward the rear of the backrest.

Also, for example, the sitter detector may include sensors that detect presence of an object within a predetermined distance in a horizontal direction. The sensors may be arranged in an up-and-down direction to detect a front side of the backrest of the seat. A height of an uppermost one of sensors detecting the object may be detected as the height of the head of the sitter.

With this configuration, the height of the head of the sitter can be readily detected on the basis of the result of detection made by the sensors. With this configuration, therefore, the fan can be readily placed at the position of the head of the sitter.

The seat according to the aspect of the present disclosure may further include, for example, a rearward detector that detects a position of a head of an object person located behind the seat, an angle motor that serves to adjust an angle of the airflow generated by the fan, and an angle controller that controls the angle motor. The angle controller may control the angle motor such that the fan generates the airflow that is not directed to the position of the head of the object person detected by the rearward detector.

This configuration can prevent air around the face of the sitter from directly hitting the object person located behind the seat. With this configuration, therefore, the risk of transmission to the object person located behind the seat can also be reduced.

Also, for example, the angle motor may adjust an angle in an up-and-down direction. The angle controller may control an angle of the airflow in the up-and-down direction on the basis of the height of the head of the object person detected by the rearward detector.

Thus, the risk of transmission to the object person located behind the seat can be reduced with a simpler configuration.

Also, for example, at least part of the backrest may have a ventilation structure that allows passage of a gas from a front surface to a back surface of the backrest, and the fan may be installed inside the backrest.

With this configuration, the appearance of the seat is simplified, and air around the face of the sitter can be removed toward the rear of the backrest.

The seat according to the aspect of the present disclosure may further include, for example, an acquiring unit that acquires an attribute of the sitter from a sitter identification tag that is carried by the sitter and used to identify the attribute of the sitter, an identifying unit that identifies the attribute of the sitter acquired by the acquiring unit, and an output controller that causes the fan to generate the airflow if the identifying unit determines that the attribute of the sitter is a predetermined attribute.

This configuration enables the output controller to cause the fan to generate an airflow exactly when, for example, an airborne virus is likely to be around the seat. This configuration can thus reduce power consumed to drive the fan, and can still reduce the risk of transmission to the nearby person approaching the sitter.

Also, for example, the acquiring unit may further acquire an attribute of a nearby person approaching the seat from a nearby person identification tag that is carried by the nearby person and used to identify the attribute of the nearby person. The identifying unit may further identify the attribute of the nearby person. The output controller may cause the fan to generate the airflow if the identifying unit determines that the identified attribute of the sitter and the identified attribute of the nearby person are a predetermined combination of identified attributes.

This configuration enables the output controller to drive the fan exactly when, for example, an airborne virus is likely to be around the seat. Also, with this configuration, the fan is turned off (i.e., does not generate the airflow) if a specific condition is not met. This configuration thus further reduces power consumption and reduces the risk of transmission to a specific nearby person whose risk of getting infected is to be reduced.

Also, for example, as the attribute of the sitter, sitter information indicating whether the sitter is infected with an airborne disease may be recorded in the sitter identification tag, and as the attribute of the nearby person, nearby person information indicating whether the nearby person is a pharmacist may be recorded in the nearby person identification tag. The output controller may cause the fan to generate the airflow if the identifying unit determines from the sitter identification tag that the sitter is infected with an airborne disease and determines from the nearby person information that the nearby person is a pharmacist.

With this configuration, in the series of steps from examination to dispensing of medicines in a clinic, the risk of transmission from a patient infected with an airborne disease to the pharmacist can be reduced.

Embodiments of the present disclosure will now be described in detail with reference to the drawings.

All the embodiments described herein present either general or specific examples. Numerical values, shapes, materials, components, arrangements and modes of connection of the components, steps, and the sequence of the steps that are presented in the following embodiments are merely examples, and are not intended to limit the scope of the appended claims. Of the components described in the following embodiments, those not recited in the independent claims which define the broadest concepts are described as optional components.

Note that the attached drawings are not necessarily exact. Throughout the drawings, substantially the same components are denoted by the same reference numerals and their overlapping descriptions are omitted or simplified.

In the present specification, the term "front" refers to a direction opposite the backrest when viewed from the sitter sitting on the seat.

In the present specification and drawings, the X-axis, Y-axis, and Z-axis represent three axes of a three-dimensional orthogonal coordinate system. The X-axis and the Y-axis are axes that are orthogonal to each other and are both orthogonal to the Z-axis.

The Z-axis direction is, for example, a vertical direction, and the positive side of the Z-axis may be referred to as "up". The positive side of the Y-axis may be referred to as "front", and the negative side of the Y-axis may be referred to as "rear". The X-axis direction may be referred to as "right-and-left direction".

In the present specification, a person sitting on a seat is referred to as "sitter", a person located in front of the seat is referred to as "nearby person", and a person located behind the seat is referred to as "object person".

First Embodiment

A seat according to a first embodiment will now be described with reference to FIG. 1 and FIG. 2.

FIG. 1 is a schematic perspective view of a seat 100 according to the first embodiment of the present disclosure. FIG. 2 is a schematic lateral view of the seat 100 according to the first embodiment of the present disclosure.

The seat 100 is a seat that diffuses air around the face of a sitter 101 sitting on a seating portion 1 of the seat 100. Specifically, the seat 100 is a seat that moves air around the head (or more specifically, face) of the sitter 101 toward the rear of a backrest 102.

The seat 100 includes the seating portion 1, the backrest 102, a fan 103, an output controller 106, and a power supply 107.

The seating portion 1 has a seating surface on which the sitter 101 of the seat 100 sits. In FIG. 1 and FIG. 2, the seating portion 1 is illustrated as a box that is formed integrally with leg portions. Alternatively, for example, the seat 100 may include leg portions and a seating portion that is connected to the leg portions and has a seating surface.

The backrest 102 is a backrest that supports the sitter 101 sitting on the seating portion 1. For example, the backrest 102 is connected to the seating portion 1 and disposed perpendicularly to the seating surface of the seating portion 1.

The fan 103 is a fan that generates an airflow 105. Specifically, the fan 103 is installed on the backrest 102 at a predetermined height corresponding to a head height 104 of the sitter 101 of the seat 100. The fan 103 generates the airflow 105 flowing from the front toward the rear of the backrest 102.

The seat 100 includes at least one backrest 102, but the number is not particularly limited to this. The seat 100 also includes at least one fan 103. FIG. 1 and FIG. 2 illustrate an example where the seat 100 includes two fans 103. The fans 103 are installed at the same height 104 and spaced apart in the right-and-left direction of the backrest 102. The two fans 103 illustrated in FIG. 1 and FIG. 2 are installed on the respective right and left sides of the backrest 102. The fans 103 may be installed at the top of the backrest 102.

With two or more fans 103, for example, even when the seat 100 is a long seat, such as a sofa, which accommodates more than one person, the risk of transmission to a person approaching the sitter 101 can be reduced by appropriately setting the distance between the fans 103. When the fans 103 are arranged on the backrest 102 with a distance therebetween, the airflow 105 generated by the fans 103 can be prevented from being blocked by the sitter 101 sitting on the seat 100. It is thus possible to reduce sitter's discomfort caused by the airflow 105 hitting the sitter 101, and to remove air around the face of the sitter 101 toward the rear of the seat 100.

The distance between the fans 103 is not particularly limited, but may range, for example, from about 50 cm to about 1 m.

The output controller 106 is a control device for controlling the drive of the fans 103. Specifically, the output controller 106 controls the on/off of the fans 103 to cause the fans 103 to generate, or not to generate, the airflow 105. The output controller 106 is implemented, for example, by a processor that executes a control program and a memory that stores the control program.

The power supply 107 is a power supply circuit for supplying power to electronic devices, such as the output controller 106 and the fans 103, included in the seat 100. For example, the power supply 107 converts power supplied from an external commercial power supply, and supplies the resulting power to electronic devices, such as the fans 103. The power supply 107 is electrically connected, for example, by wiring to the output controller 106 and the fans 103. The power supply 107 may further include a battery (not shown) that supplies power to the power supply 107.

For example, the output controller 106 and the power supply 107 are housed inside the seat 100. The output controller 106 and the power supply 107 may be installed outside the seat 100.

As described above, the seat 100 according to the first embodiment includes the backrest 102 and the fans 103. The fans 103 are installed on the backrest 102 at a position corresponding to the head height 104 of the sitter 101 of the seat 100. The fans 103 generate the airflow 105 flowing from the front toward the rear of the backrest 102, so as to send air from around the face of the sitter 101 toward the rear of the seat 100.

With this configuration, air around the head of the sitter 101 can be moved toward the rear of the backrest 102. Therefore, even if the sitter 101 is infected with an airborne disease, the risk of transmission to a nearby person approaching the sitter 101 can be reduced. In particular, when the fans 103 are installed on the backrest 102 at the height 104 of the head (or more specifically, face) of the sitter 101, air which is around the face of the sitter 101 and likely to contain a high concentration of virus can be removed toward the rear of the backrest 102. Therefore, the seat 100 can reduce the risk of transmission to a nearby person approaching the sitter 101 who is infected with an airborne disease.

Figure 2:
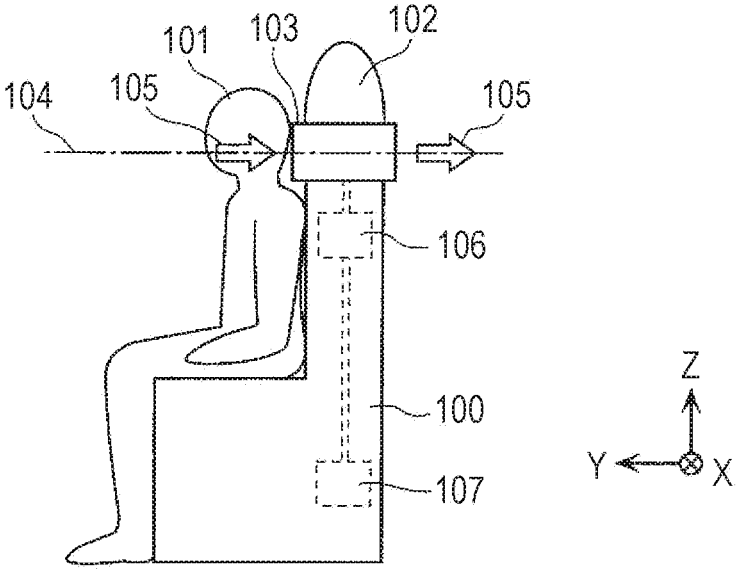
FIG. 2 is a schematic lateral view of the seat according to the first embodiment of the present disclosure.
Figure 11:
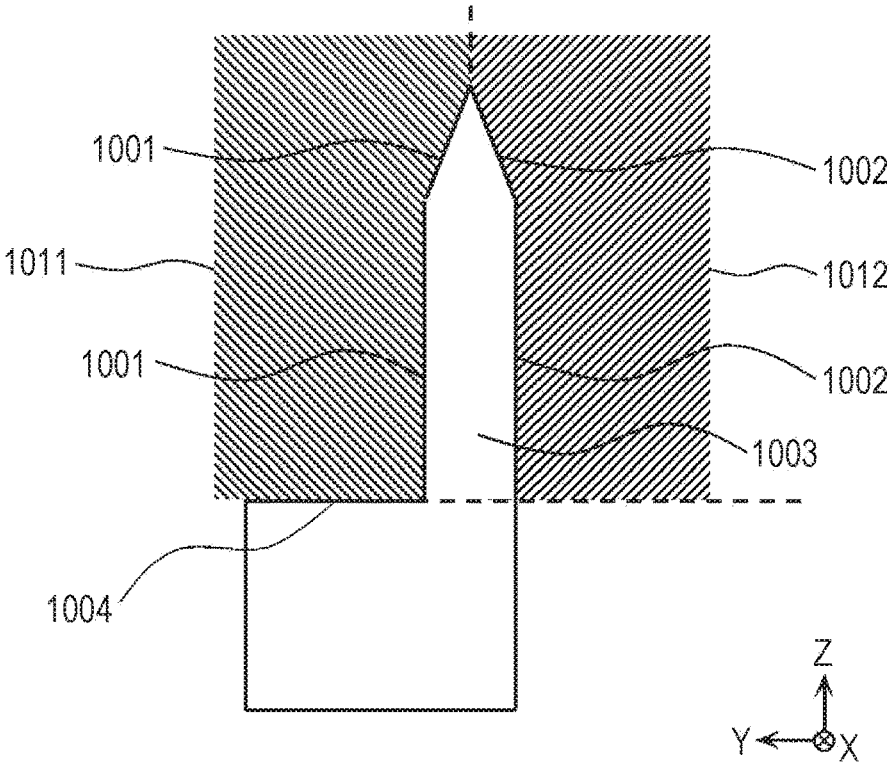
FIG. 11 is a diagram for explaining a first surface, a second surface, a side face, a support, a first region, and a second region.

As illustrated in FIG. 1, FIG. 2, and FIG. 11, the seat 100 may include the backrest 102 having a first surface 1001, a second surface 1002 opposite the first surface 1001, and side faces 1003 each between the first surface 1001 and the second surface 1002; a support 1004 connected to the first surface 1001; and the fans 103 disposed on the respective side faces 1003 and configured to generate an airflow flowing from a first region 1011 in contact with the first surface 1001 to a second region 1012 in contact with the second surface 1002. Note that FIG. 11 is a simplified diagram of FIG. 2 and is presented for explaining the first surface 1001, the second surface 1002, the side faces 1003, the support 1004, the first region 1011, and the second region 1012. The fans 103 may each have a cylinder 1031 (see FIG. 12) that allows an airflow to pass therethrough.

Figure 12:
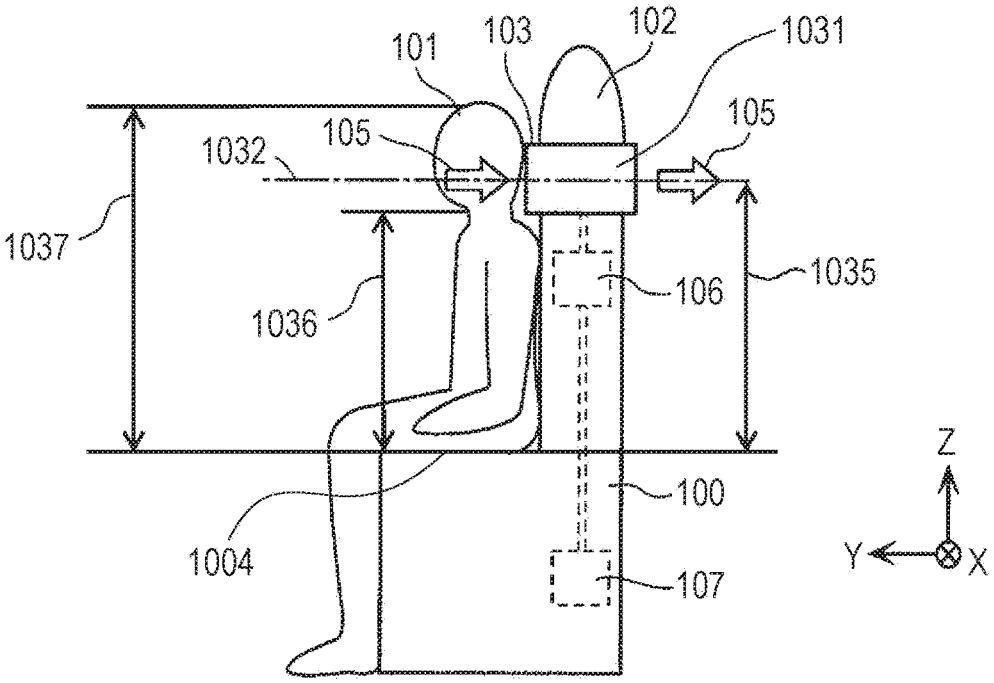
FIG. 12 is a diagram for explaining a cylinder, a central axis, a first distance, a second distance, and a third distance.
Figure 13:
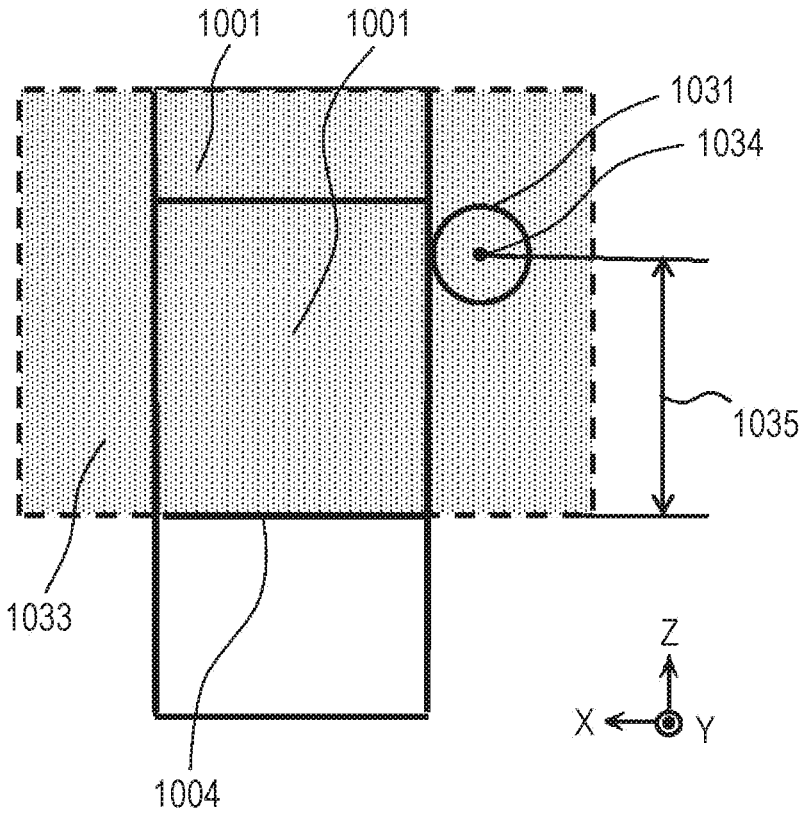
FIG. 13 is a diagram for explaining a plane and a point of intersection.

As illustrated in FIG. 12 and FIG. 13, a first distance 1035 between the support 1004 and a point of intersection 1034 between a central axis 1032 of the cylinder 1031 and a plane 1033 containing the first surface 1001 may be greater than a second distance 1036 between the support 1004 and the lower end of the face of the sitter 101 sitting on the support 1004, and smaller than a third distance 1037 between the support 1004 and the top of the head of the sitter 101. Note that FIG. 12 is a diagram for explaining the cylinder 1031, the central axis 1032, the first distance 1035, the second distance 1036, and the third distance 1037. Also note that FIG. 13 is a diagram for explaining the plane 1033 and the point of intersection 1034.

Second Embodiment

A seat according to a second embodiment will now be described with reference to FIG. 3 and FIG. 4.

Figure 3:
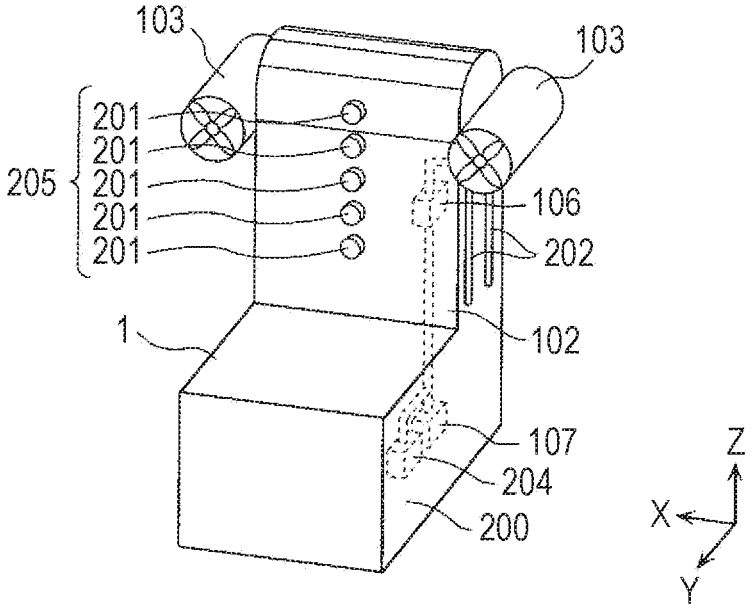
FIG. 3 is a schematic perspective view of a seat according to a second embodiment of the present disclosure.
Figure 4:
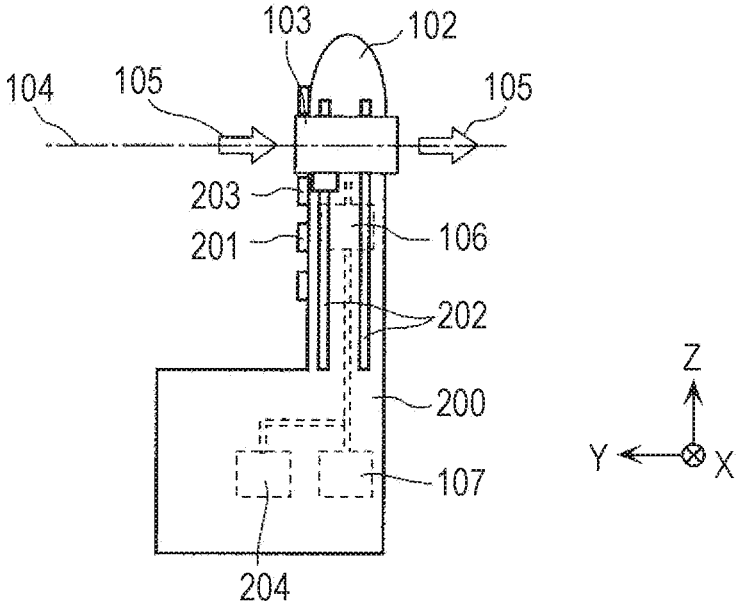
FIG. 4 is a schematic lateral view of the seat according to the second embodiment of the present disclosure.

FIG. 3 is a schematic perspective view of a seat 200 according to the second embodiment of the present disclosure. FIG. 4 is a schematic lateral view of the seat 200 according to the second embodiment of the present disclosure. In the description of the seat 200 according to the second embodiment, components that are substantially the same as those of the seat 100 according to the first embodiment are denoted by the same reference numerals and their description will be omitted. Note that the sitter 101 is not shown in FIG. 3 and FIG. 4.

Like the seat 100 of the first embodiment, the seat 200 is a seat that diffuses air around the face of the sitter 101 sitting on the seating portion 1 of the seat 200. Specifically, the seat 200 is a seat that moves air around the face of the sitter 101 from the front toward the rear of the backrest 102.

In addition to the components of the seat 100 according to the first embodiment, the seat 200 according to the second embodiment includes a sitter detector 205, a lifting-and-lowering guide 202, a lifting-and-lowering motor 203, and a lifting-and-lowering controller 204.

The sitter detector 205 detects the head height 104 of the sitter 101. The sitter detector 205 includes, for example, sensors 201.

The sensors 201 are arranged in the up-and-down direction to detect the front side of the backrest 102 of the seat 200. The height of the uppermost one of sensors 201 detecting an object is detected as the head height 104 of the sitter 101. The sensors 201 are, for example, distance sensors that detect the presence of an object within a predetermined distance (e.g., 10 cm) in the horizontal direction in front of the seat 200. The sensors 201 may be, for example, optical active sensors, ultrasonic sensors, or contact sensors.

Since the sitter detector 205 is implemented by the sensors 201 that detect the presence of an object, the head height 104 of the sitter 101 can be readily detected on the basis of the result of detection made by the sensors 201. With this configuration, therefore, the fans 103 can be readily positioned at the head height 104 of the sitter 101.

The lifting-and-lowering guide 202 is a guide for moving up and down the fans 103 when the lifting-and-lowering motor 203 is driven by the lifting-and-lowering controller 204.

The lifting-and-lowering motor 203 is a motor that moves up and down along the lifting-and-lowering guide 202 to move the fans 103 up and down.

The lifting-and-lowering guide 202 and the lifting-and-lowering motor 203 constitute, for example, a single-axis stage and are connected to the fans 103.

The lifting-and-lowering controller 204 is a control device for moving the fans 103 up and down by driving the lifting-and-lowering motor 203. The lifting-and-lowering controller 204 is implemented, for example, by a processor that executes a control program and a memory that stores the control program.

The fans 103, the sitter detector 205, the lifting-and-lowering motor 203, the output controller 106, the lifting-and-lowering controller 204, and the power supply 107 are electrically connected, for example, by wiring.

As described above, in addition to the components of the seat 100 according to the first embodiment, the seat 200 according to the second embodiment includes the sensors 201 that are arranged in the up-and-down direction on the front surface of the backrest 102 of the seat 200 to detect the presence of an object forward of the backrest 102. The presence of the sitter 101 is detected by the sensors 201 when the sitter 101 sits on the seat 200. The height of the uppermost sensor 201 detecting the sitter 101 reflects the sitting height (i.e., the head height 104) of the sitter 101. Thus by using the result of detection made by the sensors 201, the lifting-and-lowering controller 204 controls the lifting-and-lowering motor 203 to adjust the height of the fans 103 to the head height 104 of the sitter 101.

With this configuration, the height of the fans 103 can be adjusted to the height 104 corresponding to the sitting height of the sitter 101. With this configuration, therefore, regardless of the sitting height of the sitter 101, the seat 200 can move air around the face of the sitter 101 from the front to the rear of the backrest 102.

In the present embodiment, the sitter detector 205 detects the head height 104 of the sitter 101 with the sensors 201, which are distance sensors. However, the sensors 201 are not limited to this. For example, the sensors 201 may be replaced by a camera. In this case, the sitter detector 205 may detect the head height 104 of the sitter 101 on the basis of a result obtained by processing an image acquired using the camera.

The lifting-and-lowering controller 204 adjusts the height of the fans 103 on the basis of the result of detection made by the sensors 201. The output controller 106 may also use the result of detection made by the sensors 201. For example, if none of the sensors 201 detects any object, the output controller 106 determines that the sitter 101 is not present (i.e., no one is sitting on the seat 200) and turns off the fans 103 (i.e., causes the fans 103 not to generate an airflow), whereas if any of the sensors 201 detects an object, the output controller 106 determines that the sitter 101 is present and turns on the fans 103 (i.e., causes the fans 103 to generate an airflow).

Third Embodiment

A seat according to a third embodiment will now be described with reference to FIG. 5 and FIG. 6.

Figure 5:
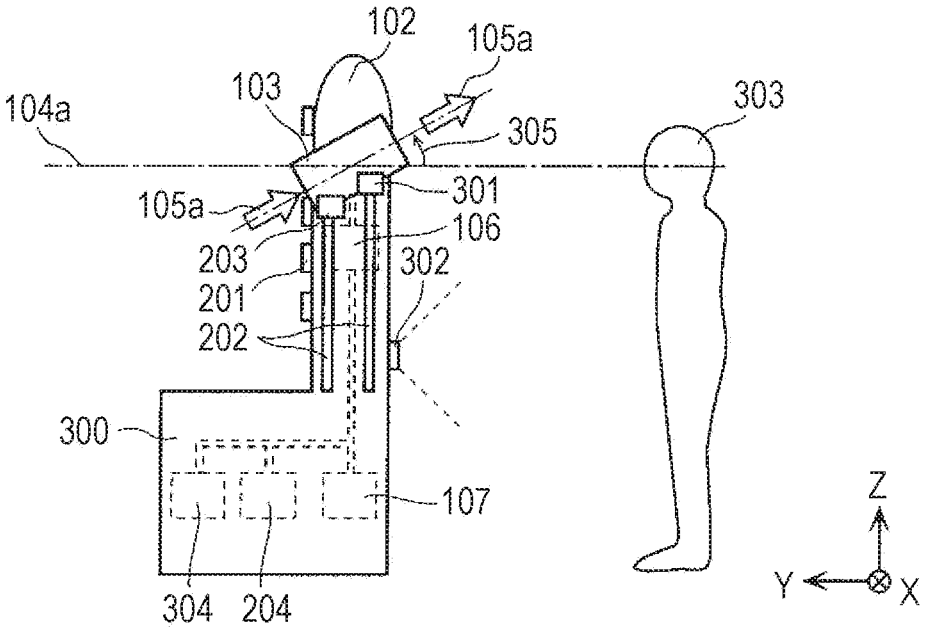
FIG. 5 is a schematic lateral view of a seat according to a third embodiment of the present disclosure.

FIG. 5 is a schematic lateral view of a seat 300 according to the third embodiment of the present disclosure. In the description of the seat 300 according to the third embodiment, components that are substantially the same as those of the seat 100 according to the first embodiment or the seat 200 according to the second embodiment are denoted by the same reference numerals and their description will be omitted. Note that the sitter 101 is not shown in FIG. 5.

Like the seat 100 of the first embodiment, the seat 300 is a seat that diffuses air around the face of the sitter 101 sitting on the seating portion 1 of the seat 300. Specifically, the seat 300 is a seat that moves air around the face of the sitter 101 from the front toward the rear of the backrest 102.

In addition to the components of the seat 200 according to the second embodiment, the seat 300 according to the third embodiment includes an angle motor 301, a rearward detector 302, and an angle controller 304.

The angle motor 301 is a motor for adjusting the direction of the fans 103. Specifically, by adjusting the position of the fans 103, the angle motor 301 controls the direction of an airflow 105*a* generated by each fan 103. That is, the angle motor 301 adjusts the angle (control angle 305) of the airflow 105*a* generated by the fan 103. The angle motor 301 adjusts the angle, for example, in the up-and-down direction (or direction of rotation about the X-axis direction).

The rearward detector 302 detects whether an object person 303, who is a person located behind the seat 300, is present. Specifically, the rearward detector 302 detects the position of the head of the object person 303. For example, the rearward detector 302 detects a head height 104*a* of the object person 303.

The rearward detector 302 is, for example, a camera with an image sensor, such as a charge-coupled device (CCD) sensor or a complementary metal oxide semiconductor (CMOS) sensor.

The angle controller 304 is a control device that controls the angle motor 301 to change the position of the fans 103 such that the airflow 105*a* is not generated toward the head of the object person 303 located behind the seat 300. Specifically, the angle controller 304 controls the angle motor 301 such that each fan 103 generates the airflow 105*a* that is not directed to the position of the head of the object person 303 detected by the rearward detector 302. For example, the angle controller 304 controls the control angle 305 of the airflow 105*a* in the up-and-down direction (or direction of rotation about the X-axis direction) on the basis of the head height 104*a* of the object person 303 detected by the rearward detector 302.

The angle controller 304 is implemented, for example, by a processor that executes a control program and a memory that stores the control program.

The fans 103, the angle motor 301, the rearward detector 302, the angle controller 304, the sitter detector 205, the lifting-and-lowering motor 203, the output controller 106, the lifting-and-lowering controller 204, and the power supply 107 are electrically connected, for example, by wiring.

As described above, in addition to the components of the seat 100 according to the first embodiment, the seat 300 according to the third embodiment includes the rearward detector 302 for detecting the presence of the object person 303 behind the backrest 102 of the seat 300, if the object person 303 is present behind the seat 300, the rearward detector 302 detects the height of the object person 303 (or specifically, the position of the head of the object person 303), and the angle controller 304 controls the angle motor 301 on the basis of the result of detection made by the rearward detector 302. Specifically, the angle controller 304 controls the position of the fans 103 by controlling the angle motor 301 such that at least the airflow 105*a* forms the control angle 305 in the up-and-down direction, with respect to the line representing the head height 104*a* of the object person 303 behind the seat 300. For example, if the head height 104*a* of the object person 303 behind the seat 300 is the same as the height of the fans 103, the control angle 305 is about 20 degrees upward from the line representing the head height 104*a*. The angle controller 304 thus controls the control angle 305 such that the airflow 105*a* is not generated toward at least the head of the object person 303 behind the seat 300.

Figure 6:
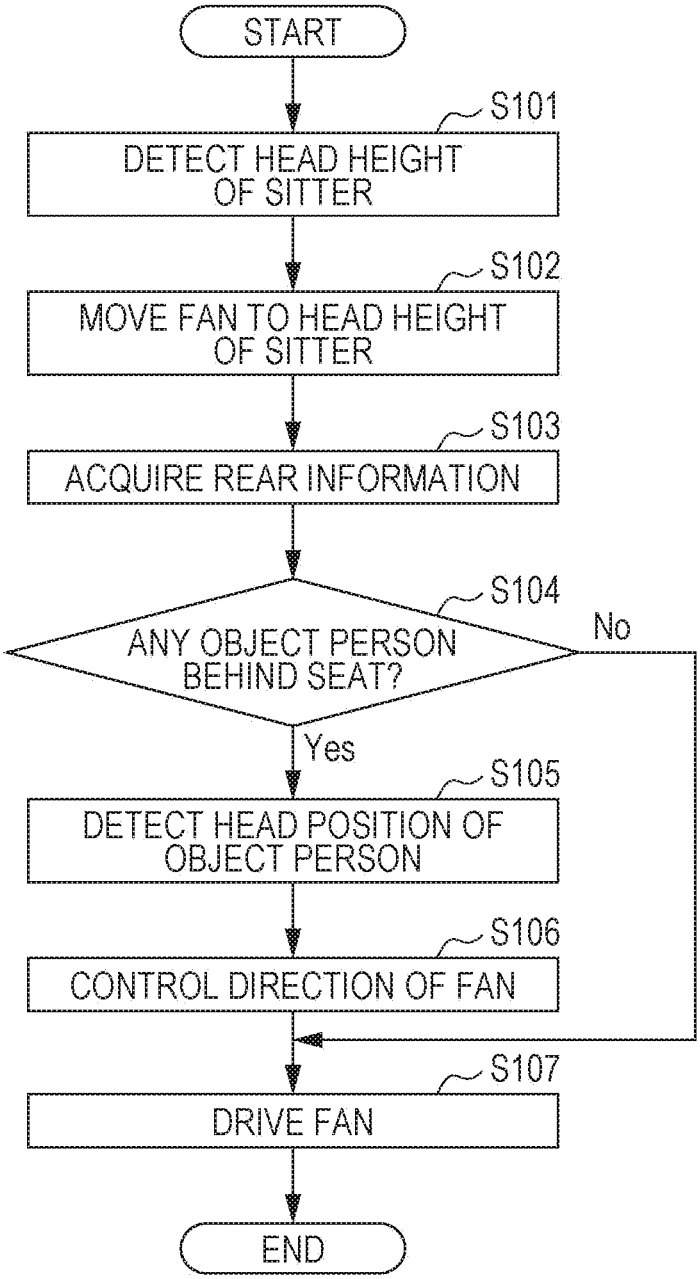
FIG. 6 is a flowchart explaining the procedure of how the seat according to the third embodiment of the present disclosure controls a fan.

FIG. 6 is a flowchart explaining the procedure of how the seat 300 according to the third embodiment of the present disclosure controls the fan 103.

First, the sitter detector 205 detects the head height (e.g., the head height 104 illustrated in FIG. 4) of the sitter 101 (step S101).

Next, the lifting-and-lowering controller 204 moves the fan 103 to the head height 104 of the sitter 101 (step S102).

Next, the rearward detector 302 acquires rear information indicating whether the object person 303 is present behind the seat 300 (step 3103). For example, the rear information is an image. In step S103, for example, the rearward detector 302 acquires the rear information by capturing an image of the rear of the seat 300.

From the rear information acquired in step S103, the rearward detector 302 determines whether the object person 303 is present behind the seat 300 (step S104), In step S104, for example, the rearward detector 302 analyzes an image, which is an example of the rear information acquired in step S103, to determine whether the object person 303 is present behind the seat 300.

If determining that the object person 303 is present behind the seat 300 (Yes in step S104), the rearward detector 302 detects the position of the head of the object person 303 (or specifically, the head height 104*a* of the object person 303) (step 3105). For example, if the rear information acquired in step S103 is an image, the rearward detector 302 analyzes the image to detect the head height 104*a* of the object person 303 in step S105.

Next, on the basis of the head height 104*a* of the object person 303 detected by the rearward detector 302 in step S145, the angle controller 304 controls the direction (or specifically, position) of the fan 103 (step S106). In step S106, for example, the angle controller 304 controls the control angle 305 by controlling the angle motor 301 such that the airflow 105*a* generated by the fan 103 is not directed toward the head of the object person 303.

Upon completion of step S106, or if the rearward detector 302 determines that the object person 303 is not present behind the seat 300 (No in step S104), the output controller 106 drives the fan 103 to cause the fan 103 to generate the airflow 105*a* (step S107).

As described above, in addition to the components of the seat 200 according to the second embodiment, the seat 300 includes the rearward detector 302 that detects the position of the head of the object person 303 located behind the seat 300, the angle motor 301 for adjusting the angle (control angle 305) of the airflow 105*a* generated by each fan 103, and the angle controller 304 that controls the angle motor 301. The angle controller 304 controls the angle motor 301 such that the fan 103 generates the airflow 105*a* that is not directed to the position of the head of the object person 303 detected by the rearward detector 302.

With this configuration, even if the object person 303 is present behind the seat 300, air around the face of the sitter 101 can be diffused in such a manner as to avoid the object person 303. That is, the seat 300 can prevent air around the face of the sitter 101 from directly hitting the object person 303 located behind the seat 300. Therefore, without increasing the risk of transmission to the object person 303 behind the seat 300, the seat 300 can reduce the risk of transmission to a nearby person approaching the sitter 101.

In the present embodiment, the angle controller 304 controls the angle motor 301 to control the control angle 305 of the airflow 105*a* in the up-and-down direction generated by each fan 103. The angle controller 304 may control not only the angle in the up-and-down direction, but also the angle in the right-and-left direction (or direction of rotation about the Y-axis direction).

With this configuration, again, the risk of transmission to a nearby person approaching the sitter 101 from the front can be reduced without increasing the risk of transmission to the object person 303 behind the seat 300.

The angle motor 301 may adjust the angle in the up-and-down direction, and the angle controller 304 may control the angle (control angle 305) of the airflow 105*a* in the up-and-down direction on the basis of the head height 104*a* of the object person 303 detected by the rearward detector 302.

The risk of transmission to the object person 303 located behind the seat 300 can thus be reduced with a simpler configuration.

Fourth Embodiment

A seat according to a fourth embodiment will now be described with reference to FIG. 7 and FIG. 8.

Figure 7:
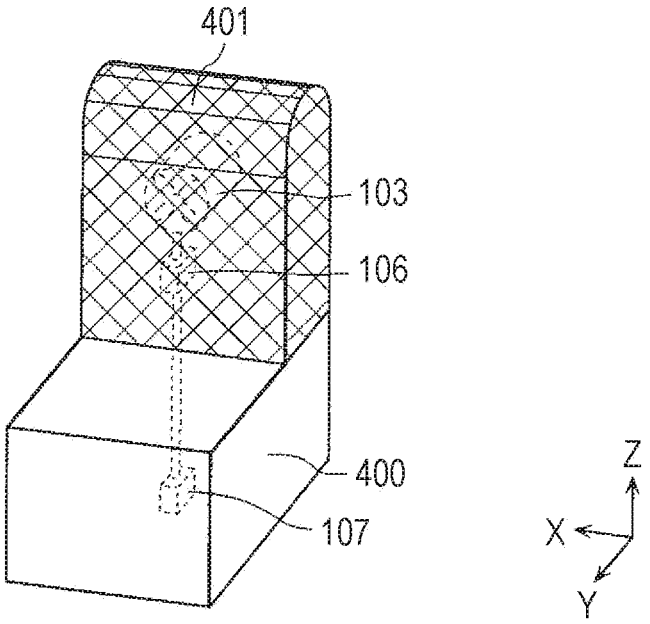
FIG. 7 is a schematic perspective view of a seat according to a fourth embodiment of the present disclosure.

FIG. 7 is a schematic perspective view of a seat 400 according to the fourth embodiment of the present disclosure. FIG. 8 is a schematic lateral view of the seat 400 according to the fourth embodiment of the present disclosure. In the description of the seat 400 according to the fourth embodiment, components that are substantially the same as those of the seat 100 according to the first embodiment are denoted by the same reference numerals and their description will be omitted. Note that the sitter 101 is not shown in FIG. 7 and FIG. 8.

Like the seat 100 of the first embodiment, the seat 400 is a seat that diffuses air around the face of the sitter 101 sitting on the seating portion 1 of the seat 400. Specifically, the seat 400 is a seat that moves air around the face of the sitter 101 from the front toward the rear of a backrest 401.

The seat 400 of the fourth embodiment differs from the seat 100 of the first embodiment in that the backrest 401 has a ventilation structure and that the fan 103 is disposed inside the seat 400 (or specifically, the backrest 401).

Figure 8:
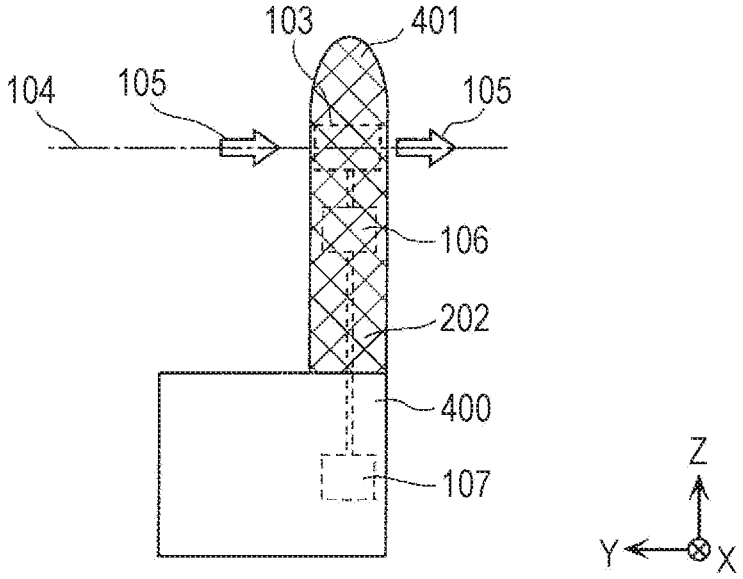
FIG. 8 is a schematic lateral view of the seat according to the fourth embodiment of the present disclosure.

As illustrated in FIG. 7 and FIG. 8, the backrest 401 of the seat 400 has a ventilation structure. For example, FIG. 7 and FIG. 8 illustrate the backrest 401 having an outer surface of cloth that has a mesh structure as the ventilation structure.

For example, the backrest 401 has a mesh structure over the entire surface thereof and allows passage of air from the front surface to the back surface of the backrest 401. The fan 103 is disposed inside the backrest 401 at the head height 104 of the sitter 101. The backrest 401 includes, for example, a bar frame that serves as a support structure for the backrest 401, and a cloth that covers the bar frame and has a mesh structure.

With this configuration, the fan 103 can be hidden inside the backrest 401 when the seat 400 is viewed from outside. The seat 400 thus looks like a normal seat and is simple in appearance. Since the fan 103 is positioned near the head of the sitter 101, the presence of the fan 103 is less likely to be noticed by a person viewing the seat 400. At the same time, since air around the face of the sitter 101 can still be removed toward the rear of the seat 400, it is possible to reduce the risk of transmission to a nearby person approaching the sitter 101.

Although the backrest 401 of the seat 400 has a ventilation structure over the entire surface thereof in the present embodiment, the backrest 401 does not necessarily need to have a ventilation structure over the entire surface thereof. For example, except in the area through which the airflow 105 generated by the fan 103 passes, the backrest 401 does not necessarily need to allow air to pass therethrough.

Fifth Embodiment

A seat according to a fifth embodiment will now be described with reference to FIG. 9 and FIG. 10.

Figure 9:
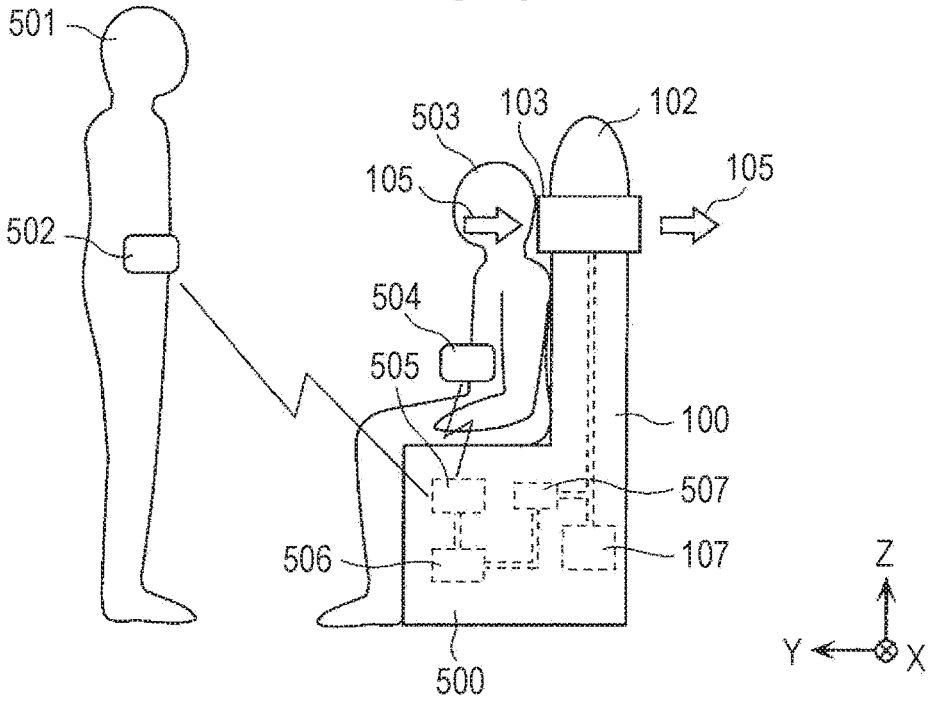
FIG. 9 is a schematic lateral view of a seat according to a fifth embodiment of the present disclosure.

FIG. 9 is a schematic lateral view of a seat 500 according to the fifth embodiment of the present disclosure. In the description of the seat 500 according to the fifth embodiment, components that are substantially the same as those of the seat 100 according to the first embodiment are denoted by the same reference numerals and their description will be omitted.

Like the seat 100 of the first embodiment, the seat 500 is a seat that diffuses air around the face of a sitter 503 sitting on the seating portion 1 of the seat 500. Specifically, the seat 500 is a seat that moves air around the face of the sitter 503 from the front toward the rear of the backrest 102.

In addition to the components of the seat 100 according to the first embodiment, the seat 500 according to the fifth embodiment includes an acquiring unit 505 and an identifying unit 506. An output controller 507 included in the seat 500 controls the on/off of the fan 103 on the basis of the result of identification made by the identifying unit 506.

The acquiring unit 505 acquires the attribute of the sitter 503 from a sitter identification tag 504 for identifying the attribute of the sitter 503. The sitter identification tag 504 is carried by the sitter 503.

Additionally, for example, the acquiring unit 505 acquires the attribute of a nearby person 501 approaching the seat 500, from a nearby person identification tag 502 for identifying the attribute of the nearby person 501. The nearby person identification tag 502 is carried by the nearby person 501.

Here, the attribute may be age or sex of the sitter 503 or the nearby person 501, or may be occupation or disease-related information of the sitter 503 or the nearby person 501.

The sitter 503 is, for example, a patient who is infected with an airborne disease, and the nearby person 501 is, for example, a pharmacist who prepares and dispenses medicines to the sitter 503.

The sitter identification tag 504 and the nearby person identification tag 502 each are, for example, a radio frequency identification (RFID) tag that always sends out information indicating the attribute of the sitter 503 or nearby person 501.

In the sitter identification tag 504, for example, sitter information indicating whether the sitter 503 is infected with an airborne disease is recorded as the attribute of the sitter 503. In the nearby person identification tag 502, for example, nearby person information indicating whether the nearby person 501 is a pharmacist is recorded as the attribute of the nearby person 501.

The acquiring unit 505 is, for example, a communication interface for wirelessly acquiring information indicating the attribute of the sitter 503 or nearby person 501 from the sitter identification tag 504 or nearby person identification tag 502.

The identifying unit 506 identifies the attribute of the sitter 503 acquired by the acquiring unit 505. The identifying unit 506 is implemented, for example, by a processor that executes a control program and a memory that stores the control program.

The output controller 507 causes the fan 103 to generate the airflow 105 if, for example, the identifying unit 506 determines that the attribute of the sitter 503 is a predetermined attribute. The output controller 507 is implemented, for example, by a processor that executes a control program and a memory that stores the control program.

The identifying unit 506 determines whether, for example, the attribute of the sitter 503 is a predetermined attribute. The predetermined attribute may be any attribute determined in advance and is not specifically limited to, for example, information about a disease with which the sitter 503 is infected, the age of the sitter 503, or the sex of the sitter 503. For example, if the predetermined attribute is "the sitter 503 is a patient infected with an airborne disease" and the identifying unit 506 determines that sitter information acquired by the acquiring unit 505 is an attribute indicating that "the sitter 503 is a patient infected with an airborne disease", then the output controller 507 causes the fan 103 to generate the airflow 105. The predetermined attribute may be information simply indicating that the fan 103 is to be turned on or off.

For example, if the identifying unit 506 determines that the identified attribute of the sitter 503 and the identified attribute of the nearby person 501 are a predetermined combination of identified attributes, the output controller 507 causes the fan 103 to generate the airflow 105. Conversely, for example, if the identifying unit 506 determines that the identified attribute of the sitter 503 and the identified attribute of the nearby person 501 are not the predetermined combination of identified attributes, the output controller 507 does not allowhe fan 103 to generate the airflow 105.

The predetermined combination of identified attributes may be any combination and is not limited to a specific one. For example, the predetermined combination of identified attributes may be the combination of the identified attribute of the sitter 503 "a patient infected with an airborne disease" and the identified attribute of the nearby person 501 "a worker working at the clinic". The predetermined combination of identified attributes may be, for example, the combination of the identified attribute of the sitter 503 "a patient infected with an airborne disease" and the identified attribute of the nearby person 501 "a pharmacist".

For example, if the identifying unit 506 determines from sitter information that the sitter 503 is infected with an airborne disease and determines from nearby person information that the nearby person 501 is a pharmacist, then the output controller 507 causes the fan 103 to generate the airflow 105.

The fan 103, the acquiring unit 505, the identifying unit 506, the output controller 507, and the power supply 107 are electrically connected, for example, by wiring.

Figure 10:
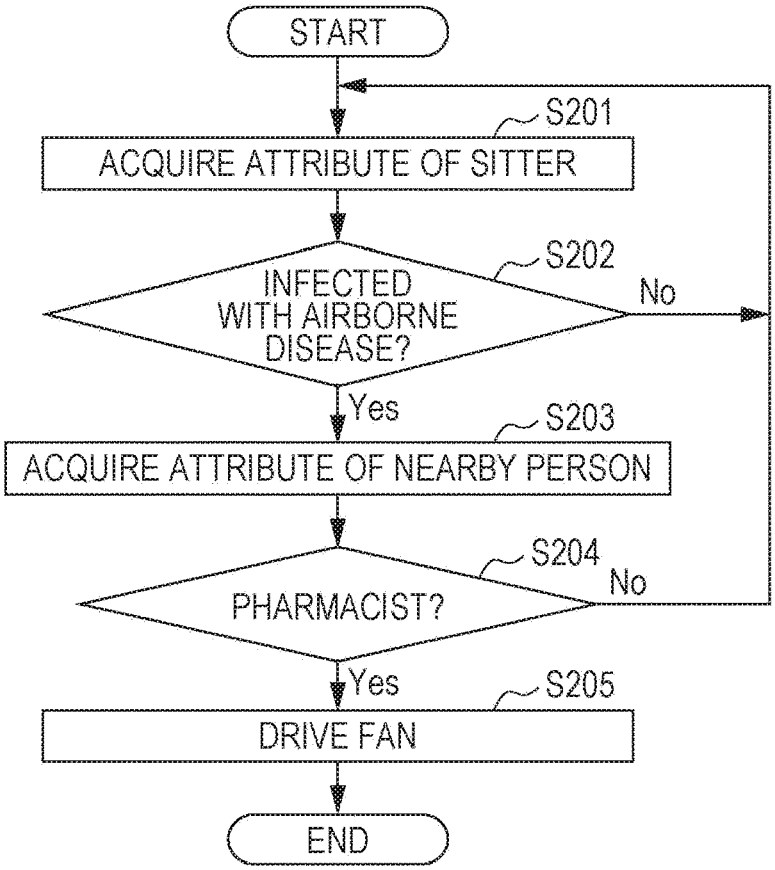
FIG. 10 is a flowchart explaining the procedure of how the seat according to the fifth embodiment of the present disclosure controls a fan.

FIG. 10 is a flowchart explaining the procedure of how the seat 500 according to the fifth embodiment of the present disclosure controls the fan 103.

First, the acquiring unit 505 acquires sitter information indicating the attribute of the sitter 503 (step S201).

From the sitter's attribute acquired by the acquiring unit 505, the identifying unit 506 determines whether the sitter 503 is infected with an airborne disease (step S202).

If the identifying unit 506 determines that the sitter 503 is not infected with an airborne disease (No in step S202), the process returns to step 3201.

If the identifying unit 506 determines that the sitter 503 is infected with an airborne disease (Yes in step S202), the acquiring unit 505 further acquires nearby person information indicating the attribute of the nearby person 501 (step 3203).

From the nearby person information acquired by the acquiring unit 505, the identifying unit 506 determines whether the nearby person 501 is a pharmacist (step S204).

If the identifying unit 506 determines that the nearby person 501 is not a pharmacist (No in step S204), the process returns to step S201.

If the identifying unit 506 determines that the nearby person 501 is a pharmacist (Yes in step S204), the output controller 507 causes the fan 103 to generate the airflow 105 by driving the fan 103 (step S205).

As described above, in addition to the components of the seat 100 according to the first embodiment, the seat 500 according to the fifth embodiment includes the acquiring unit 505 that acquires the attribute of the sitter 503 from the sitter identification tag 504 carried by the sitter 503 and used to identify the attribute of the sitter 503, the identifying unit 506 that identifies the attribute of the sitter 503 acquired by the acquiring unit 505, and the output controller 507 that causes the fan 103 to generate the airflow 105 if the identifying unit 506 determines that the attribute of the sitter 503 is a predetermined attribute.

This configuration enables the output controller 507 to cause the fan 103 to generate the airflow 105 exactly when, for example, an airborne virus is likely to be around the seat 500. This configuration can thus reduce power consumed to drive the fan 103, and can still reduce the risk of transmission to the nearby person 501 approaching the sitter 503.

For example, from the nearby person identification tag 502 for identifying the attribute of the nearby person 501 approaching the seat 500, the acquiring unit 505 further acquires the attribute of the nearby person 501. The nearby person identification tag 502 is carried by the nearby person 501. The identifying unit 506 then identifies the attribute of the nearby person 501. If the identifying unit 506 determines, for example, that the identified attribute of the sitter 503 and the identified attribute of the nearby person 501 are a predetermined combination of identified attributes, the output controller 507 causes the fan 103 to generate the airflow 105.

With this configuration, it is possible not to drive the fan 103 if the sitter 503 and the nearby person 501 are not a predetermined combination. Also, the seat 500 can drive the fan 103 exactly when, for example, an airborne virus is likely to be around the seat 500. The fan 103 is turned off (or does not generate the airflow 105) if a specific condition is not met. This further reduces power consumed by the seat 500 and enables the seat 500 to reduce the risk of transmission to a specific nearby person 501 whose risk of getting infected is to be reduced.

In the sitter identification tag 504, for example, sitter information indicating whether the sitter 503 is infected with an airborne disease is recorded as the attribute of the sitter 503. In the nearby person identification tag 502, for example, nearby person information indicating whether the nearby person 501 is a pharmacist is recorded as the attribute of the nearby person 501. In this case, for example, if the identifying unit 506 determines, from the sitter information, that the sitter 503 is infected with an airborne disease and also determines, from the nearby person information, that the nearby person 501 is a pharmacist, the output controller 507 causes the fan 103 to generate the airflow 105.

As described above, a possible combination of the sitter 503 and the nearby person 501 is, for example, a combination of a patient infected with an airborne disease, such as flu, and a pharmacist. If the identifying unit 506 identifies such a combination, the output controller 507 causes the fan 103 to generate the airflow 105. Therefore, even if the pharmacist has to approach the patient to dispense and explain prescribed medicines to the patient, the pharmacist's risk of getting infected with the disease can be reduced. That is, in the series of steps from examination to dispensing of medicines in the clinic, the seat 500 can reduce the risk of transmission from a patient infected with an airborne disease to the pharmacist.

The function of the sitter identification tag 504 may be embedded, for example, in a patient ID card or a health insurance card, and the function of the nearby person identification tag 502 may be embedded, for example, in a pharmacist's name tag. This eliminates the need for the sitter 503 or the nearby person 501 to carry the sitter identification tag 504 or the nearby person identification tag 502. The output controller 507 may perform control that causes the fan 103 to operate less powerfully when the acquiring unit 505 keeps acquiring the attribute of the sitter 503 from the sitter identification tag 504, and causes the fan 103 to operate powerfully when the acquiring unit 505 acquires the attribute of the nearby person 501 from the nearby person identification tag 502 and the identifying unit 506 determines that the combination of the attribute of the sitter 503 and the attribute of the nearby person 501 meet the condition described above.

Other Embodiments

Although the seats according to embodiments of the present disclosure have been described on the basis of the embodiments, the present disclosure is not limited to the embodiments described herein. Embodiments obtained by making various modifications conceived by a person skilled in the art to the embodiments described herein, and embodiments configured by combining components according to different embodiments may also be within the scope of one or more aspects of the present disclosure, as long as they do not depart from the scope of the present disclosure.

For example, in the embodiments described above, all or some of components of the executing unit, such as the output controller 106, the lifting-and-lowering controller 204, the angle controller 304, and the identifying unit 506, may be dedicated hardware components, or may be implemented by executing a software program appropriate for each of the components. The components may each be implemented when a program executing unit, such as a central processing unit (CPU) or a processor, reads and executes a software program recorded in a recording medium, such as a hard disk drive (HDD) or a semiconductor memory.

The components of the executing unit may be constituted by one or more electronic circuits. The one or more electronic circuits each may either be a general-purpose circuit or a dedicated circuit.

The one or more electronic circuits may include, for example, a semiconductor device, an integrated circuit (IC), or a large-scale integrated (LSI) circuit. The IC or LSI circuit may be integrated in one chip or more than one chip. The IC or LSI circuit may be referred to as, for example, a system LSI circuit, a very-large-scale integrated (VLSI) circuit, or an ultra-large-scale integrated (ULSI) circuit, depending on the level of integration. A field-programmable gate array (FPGA) programmed after manufacture of the LSI circuit may also be used for the same purposes.

For example, the seats according to the present disclosure may or may not have leg portions. Also, the seats according to the present disclosure may or may not have armrests.

Also, for example, the seats of the present disclosure may each be a single-person seat, or may each be a sofa or bench for more than one person.

Embodiments obtained by making various modifications conceived by a person skilled in the art to the embodiments described herein, and embodiments implemented by combining any of the components and functions of the embodiments described herein without departing from the scope of the present disclosure, may also be included in the present disclosure.

The seats according to the present disclosure have the function of reducing the risk of transmission to a person approaching the sitter, and are useful when used as seats for a waiting room of a hospital or clinic. The seats according to the present disclosure can also be used to reduce the risk of transmission to a doctor in a consulting room.

What is claimed is:

1. A seat comprising:

a backrest; and a fan that is installed on the backrest at a position corresponding to a height of a head of a sitter sitting on the seat and generates an airflow flowing from a front toward a rear of the backrest, wherein the backrest has a front surface, a rear surface opposite the front surface, a left side face between the front surface and the rear surface, and a right side face between the front surface and the rear surface, and the fan is installed on either the left side face of the backrest or the right side face of the backrest.

2. The seat according to claim 1, wherein the fan is a first fan, the seat further includes a second fan, the second fan being installed on the other of the left side face of the backrest or the right side face of the backrest, and the first and second fans are installed at the same height and spaced apart in a right and left direction of the backrest.

3. A seat comprising:

a backrest;

a fan that is installed on the backrest at a position corresponding to a height of a head of a sitter sitting on the seat and generates an airflow flowing from a front toward a rear of the backrest;

a sitter detector that detects the height of the head of the sitter;

a lifting-and-lowering motor that adjusts a height of the fan; and a lifting-and-lowering controller that controls the lifting-and-lowering motor, wherein the lifting-and-lowering controller controls the lifting-and-lowering motor to adjust the height of the fan to the height of the head of the sitter detected by the sitter detector.

4. The seat according to claim 3, wherein the sitter detector includes sensors that detect presence of an object within a predetermined distance in a horizontal direction; and the sensors are arranged in an up-and-down direction to detect a front side of the backrest of the seat, and a height of an uppermost one of sensors detecting the object is detected as the height of the head of the sitter.

5. A seat comprising:

a backrest;

a fan that is installed on the backrest at a position corresponding to a height of a head of a sitter sitting on the seat and generates an airflow flowing from a front toward a rear of the backrest;

a rearward detector that detects a position of a head of an object person located behind the seat;

an angle motor that serves to adjust an angle of the airflow generated by the fan; and an angle controller that controls the angle motor, wherein the angle controller controls the angle motor such that the fan generates the airflow that is not directed to the position of the head of the object person detected by the rearward detector.

6. The seat according to claim 5, wherein the angle motor adjusts an angle in an up-and-down direction; and the angle controller controls an angle of the airflow in the up-and-down direction on the basis of the height of the head of the object person detected by the rearward detector.

7. A seat comprising:

a backrest;

a fan that is installed on the backrest at a position corresponding to a height of a head of a sitter sitting on the seat and generates an airflow flowing from a front toward a rear of the backrest;

an acquiring unit that acquires an attribute of the sitter from a sitter identification tag, the sitter identification tag being carried by the sitter and used to identify the attribute of the sitter;

an identifying unit that identifies the attribute of the sitter acquired by the acquiring unit; and an output controller that causes the fan to generate the airflow if the identifying unit determines that the attribute of the sitter is a predetermined attribute.

8. The seat according to claim 7, wherein the acquiring unit further acquires an attribute of a nearby person approaching the seat from a nearby person identification tag, the nearby person identification tag being carried by the nearby person and used to identify the attribute of the nearby person;

the identifying unit further identifies the attribute of the nearby person; and the output controller causes the fan to generate the airflow if the identifying unit determines that the identified attribute of the sitter and the identified attribute of the nearby person are a predetermined combination of identified attributes.

9. The seat according to claim 8, wherein as the attribute of the sitter, sitter information indicating whether the sitter is infected with an airborne disease is recorded in the sitter identification tag;

as the attribute of the nearby person, nearby person information indicating whether the nearby person is a pharmacist is recorded in the nearby person identification tag; and the output controller causes the fan to generate the airflow if the identifying unit determines from the sitter identification tag that the sitter is infected with an airborne disease and determines from the nearby person information that the nearby person is a pharmacist.

10. A seat comprising:

a backrest that has a first surface, a second surface opposite the first surface, and a side face between the first surface and the second surface;

a support that is connected to the first surface; and a fan that is disposed on the side face and generates an airflow flowing from a first region in contact with the first surface to a second region in contact with the second surface, wherein the fan has a cylinder that allows the airflow to pass therethrough; and a first distance between the support and a point of intersection between a central axis of the cylinder and a plane containing the first surface is greater than a second distance between the support and a lower end of a face of a person sitting on the support, and smaller than a third distance between the support and a top of a head of the person.

* * * * *